US005877466A

United States Patent [19]

Bolongeat-Mobleu et al.

[11] Patent Number: 5,877,466

[45] Date of Patent: Mar. 2, 1999

[54] VACUUM ELECTRICAL SWITCH OR CIRCUIT BREAKER

[75] Inventors: Roger Bolongeat-Mobleu, Echirolles; Hans Schellekens, Meylan; Philippe Picot, Grenoble, all of France

[73] Assignee: Schneider Electric SA, France

[21] Appl. No.: 807,364

[22] Filed: Feb. 27, 1997

[30] Foreign Application Priority Data

Mar. 8, 1996 [FR] France ..... 96 03182

[51] Int. Cl.[6] ..... H01H 33/66

[52] U.S. Cl. ..... 218/118

[58] Field of Search ..... 218/1, 8, 10, 11, 218/16, 22–30, 33, 42, 118, 121, 134, 123–126, 139, 141, 142

[56] References Cited

U.S. PATENT DOCUMENTS

| | | | |
|---|---|---|---|
| 2,411,892 | 12/1946 | Peters | 200/147 |
| 2,439,952 | 4/1948 | Strom | 200/147 |
| 3,321,599 | 5/1967 | Lee | 200/144 |
| 3,891,896 | 6/1975 | Clason | 317/58 |
| 4,115,672 | 9/1978 | Lipperts | 200/144 B |
| 4,575,599 | 3/1986 | Arimoto | 200/147 A |
| 4,661,665 | 4/1987 | Carroll et al. | 200/144 B |
| 4,975,552 | 12/1990 | Niegl et al. | 200/144 B |
| 5,280,144 | 1/1994 | Bolongeat-Mobleu et al. | 200/148 R |

FOREIGN PATENT DOCUMENTS

| | | | |
|---|---|---|---|
| 0 186 030 | 7/1986 | European Pat. Off. | H01H 33/66 |
| 0 208 271 | 1/1987 | European Pat. Off. | H01H 33/66 |
| 0 709 867 | 5/1996 | European Pat. Off. | H01H 33/66 |
| 38 23 297 | 5/1989 | Germany | H01H 33/66 |
| 39 14967 | 10/1989 | Germany | H01H 33/66 |
| 40 14 768 | 11/1990 | Germany | H01H 33/66 |
| 40 413 903 | 11/1990 | Germany | H01H 33/66 |

*Primary Examiner*—Michael A. Friedhofer
*Attorney, Agent, or Firm*—Parkhurst & Wendel

[57] ABSTRACT

A vacuum switch with an elongated cartridge comprising a cylindrical housing sealed by two end plates. Inside the cylindrical housing there are two arcing contacts, one stationary and one movable. The stationary contact is securedly affixed to one of the end plates, whereas the other movable contact is mounted to axially slide inside the cartridge. At least two portions of turn are mounted in parallel. Each portion has a first end electrically connected to one of the arcing contacts and a second end electrically connected to the current input strip of the contact. The first and second ends of each portion of turn are electrically connected by a branch-off designed to disperse a part of the main current trough the potions of turn during breaking.

13 Claims, 4 Drawing Sheets

VACUUM ELECTRICAL SWITCH OR CIRCUIT BREAKER

BACKGROUND OF THE INVENTION

The present invention relates to a vacuum electrical switch designed to perform breaking in an electrical circuit notably a low or medium voltage circuit.

A circuit breaker of this kind is known as described in the Patent Application FR-2,682,808 filed by the applicant comprising a vacuum cartridge in which there are housed two arcing contacts, one stationary one of these contacts being securedly affixed to one of the end plates whereas the other, movable, contact is mounted with axial sliding inside the cartridge between a closed position and a position in which the contacts are separated resulting in formation of an arcing current. This circuit breaker comprises in addition a coil arranged coaxially outside the cartridge facing the separation gap of the arcing contacts, this coil being designed to produce an axial magnetic field in the arc formation zone. One of the shortcomings of this type of circuit breaker stems from the fact that the coil being connected in series with the arcing contacts, the whole of the main current flows through the coil. This results in it being necessary to provide a coil of large cross-section which therefore presents large overall dimensions and gives rise to considerable losses.

One of the solutions to this problem consists, as described in patent application Ser. No. 9,413,408 filed by the applicant, in fitting a branch-off means between the two ends of the coil, said means being designed to branch a part of the main current off through the coil during breaking in order to create a reduced axial magnetic field and thereby a reduced loss. However, in this embodiment, the thermal losses remain high.

SUMMARY OF THE INVENTION

The present invention solves these problems and proposes a vacuum switch or circuit breaker, of particularly simple design, enabling these losses to be further reduced.

For this purpose, the object of the present invention is to achieve an electrical switch designed to perform breaking in an electrical circuit, of the kind comprising an elongated vacuum cartridge with a cylindrical envelope sealed off by two end plates, in which there are housed two arcing contacts designed to be electrically connected respectively to two current input strips, a stationary one of which is securedly affixed to one of the above-mentioned end plates whereas the other, movable, arcing contact is mounted with axial sliding inside the cartridge, and at least one means designed to produce an axial magnetic field in the arc formation zone, this switch being characterized in that the above-mentioned means comprises at least two portions of turn mounted in parallel around the contacts, each comprising a first end electrically connected to one of the arcing contacts and a second end electrically connected to the current input strip of said contact, said portions being located outside the cartridge facing the gap separating the arcing contacts.

An object of the invention is also to achieve an electrical switch designed to perform breaking in an electrical circuit, of the kind comprising an elongated vacuum cartridge with a cylindrical envelope sealed off by two end plates, in which there are housed two arcing contacts designed to be electrically connected respectively to two current input strips, a stationary one of which is securedly affixed to one of the above-mentioned end plates whereas the other, movable, arcing contact is mounted with axial sliding inside the cartridge, and at least one means designed to produce an axial magnetic field in the arc formation zone, this switch being characterized in that the above-mentioned means comprises at least two portions of turn mounted in parallel around the contacts, each comprising a first end electrically connected to one of the arcing contacts and a second end electrically connected to the current input strip of said contact, and that the first and second ends of each portion of turn are electrically connected by a branch-off means designed to branch a part of the main current off through the portions of turn during breaking.

According to a particular feature, each portion of turn forms a fraction of turn of smaller length than a complete turn.

According to another feature, all the portions of turn taken together form a full loop.

According to a particular feature, the portions of turn are two in number.

According to a particular embodiment, the portions of turn and the branch-off means are mounted coaxially outside the cartridge.

According to a particular embodiment, the portions of turn and the branch-off means are mounted coaxially inside the cartridge.

According to another feature, the portions of turn and the branch-off means are fitted between the stationary arcing contact and the corresponding current input strip.

According to a particular embodiment, the portions of turn and the branch-off means form an integral part of one or both of the arcing contacts.

Advantageously, the portions of turn being two in number, the second end of one of the portions of turn is superposed on the first end of the other of the portions of turn.

According to a particular embodiment, the switch comprises a first bell-housing comprising several portions of turn electrically connected via one of their ends to the above-mentioned strip (or to the arcing contact) and via their opposite end to a second conducting bell-housing arranged coaxially to the cartridge and electrically connected to the arcing contact (or respectively to the above-mentioned strip).

Advantageously, the second bell-housing also comprises portions of turn, the same number of portions of turn as the first bell-housing, electrically connected via one of their ends respectively to the portions of turn of the first bell-housing and via their opposite end to said arcing contact, the portions of turn associated to the first and second bell-housing being arranged with respect to one another in such a way as to cancel out the axial components of the currents flowing in the portions of turns.

According to another feature, the above-mentioned branch-off means comprises a resistive element and/or an inductive element mounted in parallel with the portions of turn.

BRIEF DESCRIPTION OF THE DRAWINGS

But other advantages and features will become more clearly apparent from the following detailed description which refers to the accompanying drawings given as examples only and in which.

DETAILED DESCRIPTION OF THE PREFERRED EMBODIMENT

Figure 1:
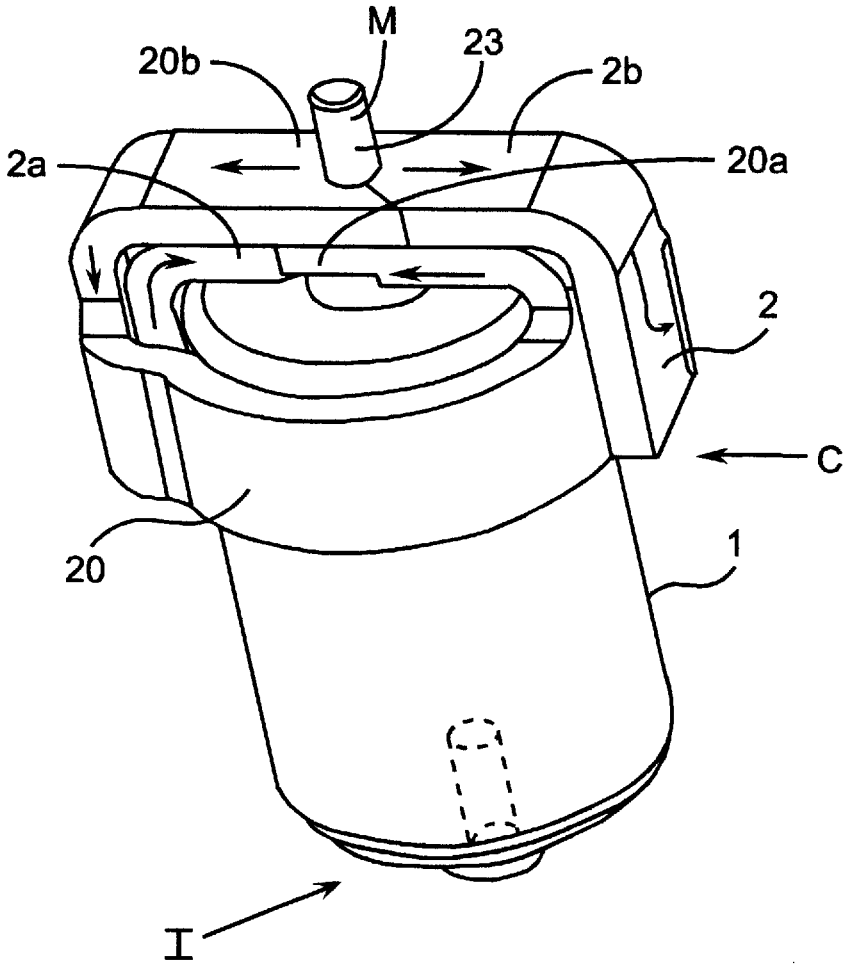
FIG. 1 is a perspective view illustrating a vacuum cartridge according to a particular embodiment of the invention.
Figure 5:
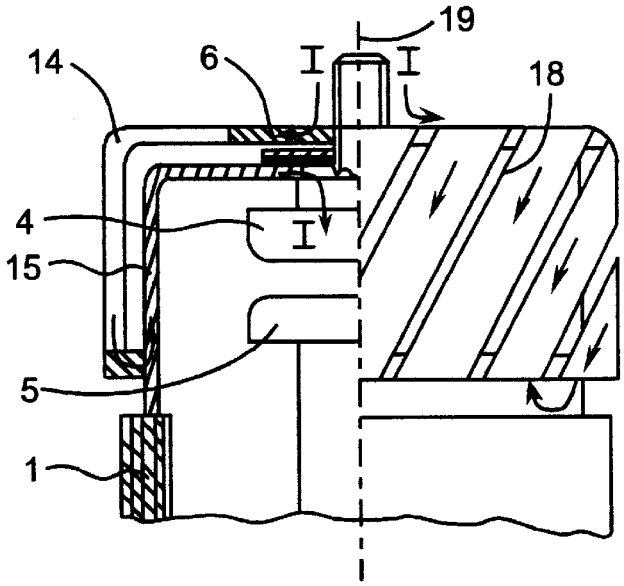
FIGS. 5 and 6 are partial views illustrating in axial cross-section two other embodiments of a vacuum switch according to the invention.

In FIG. 1 a vacuum switch I can be seen comprising a vacuum container (or cartridge) C formed mainly by a cylindrical envelope 1 closed by two opposite end plates in which two arcing contacts are housed respectively a stationary arcing contact 4 and a movable arcing contact 5 (not visible in this figure, but visible in FIG. 5). The stationary arcing contact 4 is securedly affixed to the end plate situated at the top part of the envelope 1 whereas the movable arcing contact 5 is mounted with sliding through the other of the two end plates.

Figure 2:
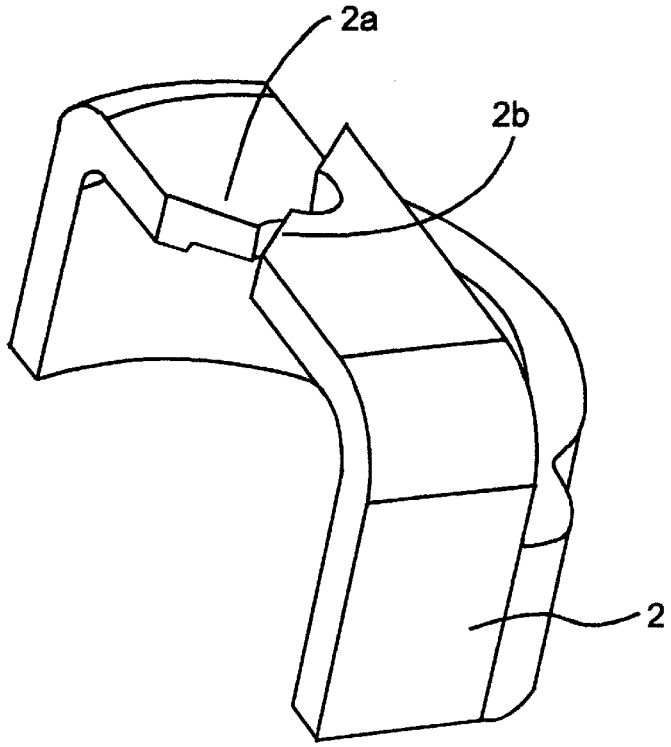
FIG. 2 is a perspective view illustrating one of the portions of turn used in the embodiment of the cartridge of the previous figure.

This switch I also comprises a means designed to create an axial magnetic field between the contacts 4, 5 in order to obtain diffusion of the arc. According to the embodiment of the invention illustrated in this figure, this means comprises two symmetrical half-turns 2, 20 such as the one 2 illustrated in FIG. 2. These two half-turns 2, 20 are fitted outside the cartridge C facing the gap separating the arcing contacts 4, 5 so as to form a full loop. Each portion of turn 2, 20 is formed by a half-turn comprising two ends 2*a*, 20*a* and 2*b*, 20*b* extending parallel to the end plates of the cartridge C.

Figure 3:
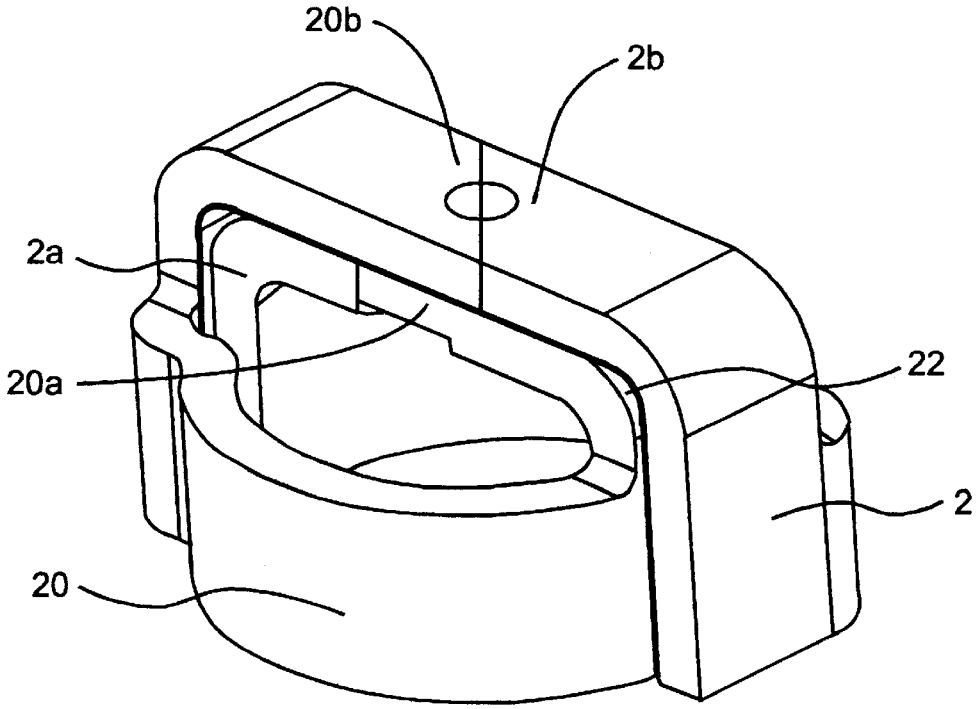
FIG. 3 is a perspective view illustrating both the portions of turn used in this same embodiment and forming the means for creating the axial field.

These ends comprise a first end 2*a*, 20*a* designed to be electrically connected to the stationary contact 4, and a second end 2*b*, 20*b* designed to be electrically connected to the current input strip 19 (not represented in this figure) to the stationary arcing contact 4. As can be seen more particularly in FIG. 3, the two first ends 2*a*, 20*a* associated respectively to the two portions of turn are of complementary shape and are arranged end to end, as are the two second ends 2*b*, 20*b*. Advantageously, a layer of insulating material 22 with a thickness of about 1 mm is interposed between the first ends 2*a*, 20*a* and the second ends 2*b*, 20*b*, said layer 22 extending up to the bottom part of the portions of turn 2, 20. The first ends 2*a*, 20*a* of portion of turn are electrically connected to the second ends 2*b*, 20*b* by a branch-off means M connected in parallel with said portions and formed in this particular embodiment by a gudgeon pin 23 made of stainless steel. This means is designed to branch off a sufficient part of the current via the portions of turn 2, 20.

Whereas the portions of turn enable fractions of current $$\left(\frac{1}{2}, \frac{1}{3}, \frac{1}{4} \text{ etc}\right)$$

to be obtained which create a magnetic field, the branch-off means M enables the current to be adjusted to precise values, which enables the necessary magnetic field to be created precisely thus minimizing losses.

Figure 7:
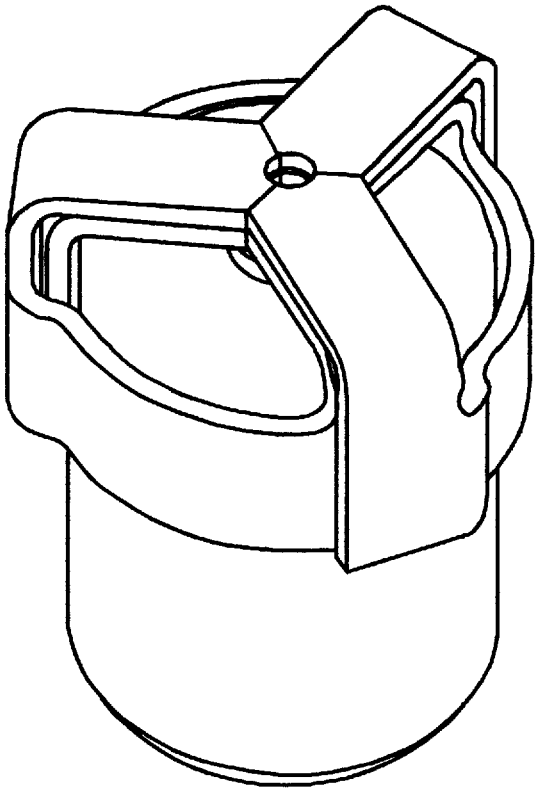
FIGS. 7 and 8 illustrate respectively a cartridge equipped with three portions of turn mounted in parallel, and a third of a turn.
Figure 8:
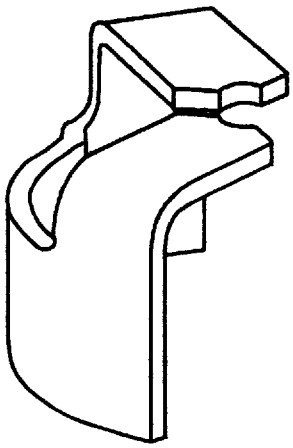

In FIG. 7, the cartridge is equipped with three thirds of a turn, which are again symmetrical. A single part is thus used (FIG. 8), after several sectors have been assembled, to achieve a complete turn.

The self-locking effect of the sectors after the gudgeon pin 11 has been fitted can also be noted, obtained on account of the special shape of the ends of the portions of turns.

Figure 4:
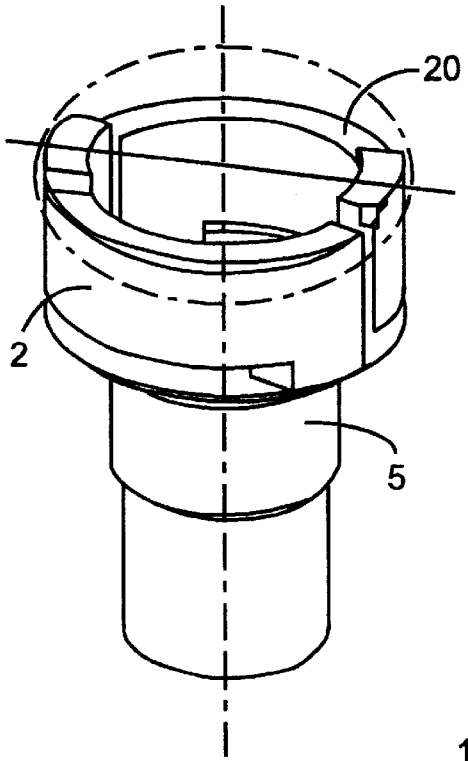
FIG. 4 is a perspective view illustrating one of the contacts of a cartridge according to another embodiment of the invention.

Referring to FIG. 4, it can be seen that according to another embodiment of the invention, the two above-mentioned half-turns 2, 20 are formed inside one 4 of the arcing contact elements. It can be noted that in this embodiment, the two arcing contacts 4, 5 will advantageously be able to be equipped with such portions of turns.

According to the invention, the cartridge C is surrounded by several portions of turns. This results in currents being able to be created whose axial component is liable to produce undesirable magnetic fields in the radial direction, these fields having the effect of repelling the arc out of the space situated between the arcing contacts. In order to compensate these axial components, in the two embodiments described above, the two ends 2*a*, 2*b* or 20*a*, 20*b* of each portion of turn 2, 20 are axially offset, and the two second ends 2*b*, 20*b* are superposed respectively on the two first ends 20*a* and 2*a*.

According to another embodiment described in FIG. 5, the switch I comprises a first bell-housing 14 comprising a certain number of portions of turns 18 for example seven.

These portions of turns comprise one end electrically connected to a strip 19 for current input to the stationary contact 4 and one end electrically connected to a second conducting bell-housing 15 fitted inside the first bell-housing 14 and electrically connected to the stationary arcing contact 4, this second bell-housing 15 performing compensation of the above-mentioned axial current components. It can be noted that this second bell-housing 15 can advantageously form an integral part of the envelope 1 of the cartridge as represented in FIG. 5, and be fixed to the first bell-housing by brazing. It can also be noted that this second bell-housing 15 could also have been placed outside the first bell-housing. In this embodiment, the branch-off means M is formed by a disk-shaped resistive element 6 interposed between the two above-mentioned bell-housings 14, 15.

Figure 6:
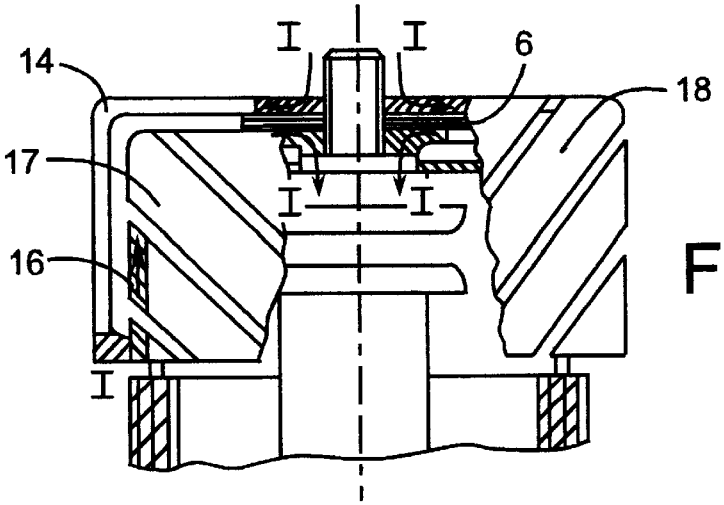

According to another embodiment illustrated in FIG. 6, the switch I comprises, as in the previous embodiment, two coaxial bell-housings 14, 16, electrically connected at their bottom part, an external 14 one of which comprises portions of turn 18 electrically connected to the strip 19 for current input to the stationary contact 4. However, in this embodiment, compensation of the axial current components is achieved by the fact that the internal bell-housing 16 also comprises portions of turn 17, said portions 17 being situated in the extension of the portions of turn 18 of the external bell-housing 14 and electrically connected to the stationary contact 4. In this case, the portions of turn belonging to the two bell-housings are arranged with respect to one another in such a way as to make the current rise so that the currents oriented in the axial direction cancel each other out. In this way, the ratio between the radial field and the axial field is reduced, which results in the effects of the above-mentioned axial current components being reduced.

The operation of a switch according to either one of the above-mentioned embodiments will be described briefly in the following description with reference to the figures.

According to the embodiment illustrated in FIGS. 1 to 4 during breaking, a current branch-off occurs through the portions of turn 2, 20. This results in creation of an axial magnetic field in the separation zone of the arcing contacts 4, 5. When two portions of turn are used, for a given section, each portion making a half-turn, a loss is obtained corresponding to 25% of that created in the case where the whole of the current would be flowing through a complete turn.

In a general manner, for a breaking capacity of 25 kA rms, it is advantageous to obtain an axial magnetic field corresponding to a current of 10 kA flowing through a turn. This results in only 40% of the available current having to flow through a turn surrounding the cartridge completely.

With a single turn, and in the case where the whole current flows through said turn, a much too great axial magnetic field is obtained during breaking; thus, during flow of a permanent current of 1250 A, a loss of 68 Watts is created.

Using a complete turn and a branch-off means, the current which flows through the turn can be adjusted and the required axial magnetic field is obtained exactly. However, during flow of the permanent current of 1250 A, the losses are 34 Watts.

With a system made up of two portions of turn in parallel and a branch-off means, the branched current can also be adjusted (up to 40% of current flowing through the portions of turn). The loss during the flow of the permanent current is then reduced to a value of 17 Watts only. In the latter case, the branch-off means can be achieved by a simple gudgeon pin which supports the two portions of turn and the cartridge, only 20% of the current flowing through this gudgeon pin, which makes assembly easier.

According to the embodiments illustrated in FIGS. 5 and 6, the branched current flows first of all through the portions of turn 18 of the first bell-housing 14 and then through the second bell-housing 15, 16 before flowing through the arcing contacts 4, 5.

It can be noted that an inductive shunt could just as well have been used instead of a resistive shunt or a combination of an inductive shunt and a resistive shunt.

Quite naturally, the invention is in no way limited to the embodiments described and illustrated which have been given for example purposes only.

On the contrary, the invention covers all the technical equivalents of the means described and combinations thereof provided the latter are performed within the spirit of the invention.

We claim:

1. An electrical switch designed to perform breaking in an electrical circuit having an elongated vacuum cartridge with a cylindrical envelope sealed off by two end plates, comprising:

two arcing contacts, the first of said two arcing contacts being movable and the second of said two arcing contacts being stationary;

two current input strips, one of said two current input strips being electrically connected respectively to one of said two arcing contacts;

the first of said two current input strips being securedly affixed to one of said two end plates;

the second of said two current strips being movable and mounted for axial sliding inside said elongated vacuum cartridge; and means for producing an axial magnetic field in an arc formation zone between said two arcing contacts comprising at least two portions of turn electrically connected in parallel around said two arcing contacts;

each of said at least two portions of turn having a first end electrically connected to one of said two arcing contacts and a second end electrically connected to the current input strip that is connected to one of two arcing contacts;

each of said at least two portions of turn being only a fraction of a complete circumferential turn; and all of said at least two portions of turn forming a single full circumferential loop.

2. The electrical switch according to claim 1 wherein the first and second ends of each said at least two portions of turn are electrically connected by a branch-off means designed to branch-off a part of a main current entering said electrical switch through the portions of turn during breaking.

3. The switch according to claim 2, wherein said at least two portions of turn and said branch-off means are mounted coaxially outside the cartridge.

4. The switch according to claim 2, wherein said at least two portions of turn and said branch-off means are mounted coaxially inside the cartridge.

5. The switch according to claim 2, wherein said at least two portions of turn and said branch-off means are fitted between the second of the two arcing contacts and the respective one of two current input strips.

6. The switch according to claim 2, wherein said at least two portions of turn and said branch-off means form an integral part of at least one of the two arcing contacts.

7. The switch according to claim 2, wherein the branch-off means comprises at least one of a resistive element and an inductive element mounted in parallel with the said at least two portions of turn.

8. The switch according to claim 4, wherein the branch-off means comprises a gudgeon pin fitted between the two ends of each said at least two portions of turn, said gudgeon cooperating with the ends of said at least two portions of turn to realize a self locking of said at least two portions of turn.

9. The switch according to claim 2, wherein said branch-off means comprises a gudgeon pin fitted between the two ends of each said at least two portions of turn.

10. The switch according to claim 1, wherein said at least two portions of turn being two in number, the second end of one of said at least two portions of turn is superposed on the first end of the other of said at least two portions of turn.

11. The switch according to claim 1, wherein said at least two portions of turns are three in number.

12. An electrical switch designed to perform breaking in an electrical circuit having an elongated vacuum cartridge with a cylindrical envelope sealed off by two end plates, comprising:

two arcing contacts, the first of said two arcing contacts being movable and the second of said two arcing contacts being stationary;

two current input strips, one of said two current input strips being electrically connected respectively to one of said two arcing contacts;

the first of said two current input strips being securedly affixed to one of said two end plates;

the second of said two current strips being movable and mounted for axial sliding inside said elongated vacuum cartridge;

means for producing an axial magnetic field in an arc formation zone between said two arcing contacts comprising at least two portions of turn electrically connected in parallel around said two arcing contacts;

each of said at least two portion of turn having a first end electrically connected to one of said two arcing contacts and a second end electrically connected to the current input strip that is connected to one of two arcing contacts;

each of said at least two portions of turn being only a fraction of a complete circumferential turn; and all of said at least two portions forming a single full circumferential loop; and a first bell-housing comprising several of said at least two portions of turn electrically connected via an end selected from a group consisting of one of two current input strips and one of two arcing contacts, and via an opposite end to a second conducting bell-housing arranged coaxially to the cartridge and electrically connected to the selected said one of two current input strips and one of said two arcing contacts.

13. The switch according to claim 12, wherein the second bell-housing comprises a same number of said at least two portions of turn electrically connected via an end respectively to the several of said at least two portions of turn of the first bell-housing and via an opposite end to said one of two arcing contacts, said at least two portions of turn associated with the first and second bell-housings being arranged with respect to one another in such a way as to cancel out an axial component of currents flowing in the several of said at least two portions of turn.

* * * * *